US012241220B2

(12) United States Patent
Karacali

(10) Patent No.: US 12,241,220 B2
(45) Date of Patent: Mar. 4, 2025

(54) WORKING MACHINE WITH COUPLING DEVICE FOR FLUID-CONDUCTING LINES

(71) Applicant: Liebherr-France SAS, Colmar (FR)

(72) Inventor: Abbas Karacali, Colmar (FR)

(73) Assignee: LIEBHERR-FRANCE SAS, Colmer (FR)

( * ) Notice: Subject to any disclaimer, the term of this patent is extended or adjusted under 35 U.S.C. 154(b) by 0 days.

(21) Appl. No.: 18/485,924

(22) Filed: Oct. 12, 2023

(65) Prior Publication Data

US 2024/0125082 A1 Apr. 18, 2024

(30) Foreign Application Priority Data

Oct. 12, 2022 (DE) ..... 10 2022 126 522.6

(51) Int. Cl.

| | |
|---|---|
| ***E02F 3/36*** | (2006.01) |
| *E02F 3/30* | (2006.01) |
| *E02F 3/32* | (2006.01) |
| *E02F 3/38* | (2006.01) |
| *E02F 9/22* | (2006.01) |

(52) U.S. Cl.
CPC ..... *E02F 3/369* (2013.01)

(58) Field of Classification Search
CPC ..... E02F 3/369; E02F 3/3636; E02F 3/3663; E02F 3/38; E02F 3/3654; E02F 3/32; E02F 3/301; E02F 9/2275
See application file for complete search history.

(56) References Cited

U.S. PATENT DOCUMENTS

| | | | | |
|---|---|---|---|---|
| 5,360,313 | A * | 11/1994 | Gilmore, Jr. | E02F 3/364 414/722 |
| 5,484,250 | A * | 1/1996 | Gilmore, Jr. | E02F 3/301 37/468 |
| 2006/0022455 | A1* | 2/2006 | Mieger | B60D 1/62 285/124.5 |
| 2022/0056662 | A1* | 2/2022 | Arnold | E02F 3/30 |

FOREIGN PATENT DOCUMENTS

| | | | | |
|---|---|---|---|---|
| AT | 412976 | B | 9/2005 | |
| DE | 69328026 | T2 | 11/2000 | |
| DE | 20300746 | U1 * | 6/2004 | E02F 9/2267 |
| DE | 102004037459 | A1 | 2/2006 | |

(Continued)

*Primary Examiner* — Bayan Salone
(74) *Attorney, Agent, or Firm* — McCoy Russell LLP

(57) ABSTRACT

The disclosure relates to a working machine, which comprises a first boom part, a second boom part detachably connectable to the first boom part, a first and a second fluid-guiding line and a coupling device for reversibly coupling the first and second lines. The first line is arranged on the first boom part and the second line is arranged on the second boom part. The coupling device comprises a first coupling part connected to the first line in a fluid-conducting manner, a second coupling part connected to the second line in a fluid-conducting manner and connected to the second boom part, and a pivot part connected to the first boom part, which can be pivoted about a pivot axis. By pivoting the pivot part about the pivot axis, the two coupling parts can be coupled in a fluid-conducting manner. According to the disclosure, the working machine comprises a locking mechanism.

17 Claims, 8 Drawing Sheets

(56) References Cited

FOREIGN PATENT DOCUMENTS

| | | | | | |
|---|---|---|---|---|---|
| DE | 102006023420 | A1 * | 11/2007 | ..... | E02F 3/3654 |
| DE | 102009056071 | A1 * | 6/2011 | ..... | A01B 59/00 |
| DE | 102014009908 | B3 * | 9/2015 | ..... | B66C 13/14 |
| DE | 102019126439 | A1 | 4/2021 | | |
| DE | 102020110523 | A1 * | 10/2021 | ..... | E02F 3/3654 |
| EP | 1239087 | A1 * | 9/2002 | ..... | E02F 3/3654 |
| EP | 3434828 | A1 * | 1/2019 | ..... | E02F 3/3654 |
| WO | WO-2005090007 | A1 * | 9/2005 | ..... | B25B 27/10 |

* cited by examiner

WORKING MACHINE WITH COUPLING DEVICE FOR FLUID-CONDUCTING LINES

CROSS REFERENCE TO RELATED APPLICATION

The present application claims priority to German Patent Application No. 10 2022 126 522.6 filed on Oct. 12, 2022. The entire contents of the above-listed application are hereby incorporated by reference for all purposes.

TECHNICAL FIELD

The present disclosure relates to a working machine, a coupling device therefor and a method for establishing an operating state of such a working machine, as described herein.

BACKGROUND

The prior art recognises a multiplicity of working machines with attachable or exchangeable tools. Such attachment tools are often attached to the booms of the working machines via quick couplings. Modern quick coupling systems are not only used to mechanically connect the attachment tool to the boom, but often also to automatically couple the hydraulic lines in the case of attachment tools with hydraulic actuators. Such hydraulic quick couplings, as known for example from EP 1 239 087 A1, are mainly used in hydraulic excavators, but now also in other working machines such as wheel loaders (see for example DE 10 2019 126 439 A1 or DE 10 2020 110 523 A1).

SUMMARY

Characteristics of such hydraulic quick coupling systems are two coupling parts that are brought together when connecting the attachment tool and boom and remain mechanically and fluidly connected to each other during operation. Since the relative position of the attachment points for the coupling parts on the attachment tool and on the boom typically does not change, the hydraulic continuity of the coupling is guaranteed.

However, a number of working tools exist that can take up a plurality of discrete positions or working positions. An example of this can be found in demolition excavators, which typically have demolition equipment and backhoe equipment mountable via mechanical quick couplers on a boom art or linkage part of the base unit (typically a carrier unit of a hydraulic excavator with a rotatable upper carriage). The backhoe equipment comprises a boom part that is connected to a machine-side boom part and has a hydraulically movable backhoe at the opposite end. Often, the backhoe equipment has a plurality of possible working positions, wherein one of the boom parts comprises a plurality of bolt receptacles that, depending on the choice of bolt receptacle, results in a different inclination of the backhoe equipment relative to the machine-side boom part.

Due to the different working positions or boom inclinations at the disconnection point between the boom part, the problem arises that conventional hydraulic couplings with two coupling halves firmly connected to the respective boom parts can no longer be used. For this reason, the hydraulic couplings are typically manually coupled and locked after the backhoe equipment has been locked in a specific working position. The couplings on the equipment side are usually not attached to the structure or the boom part, but have loose ends with hydraulic connections, which are connected to corresponding hydraulic hoses on the machine-side boom after the mechanical locking of the boom parts. The couplings on the machine side can be fixed to the steel structure of the machine or to the machine-side boom part. To allow continuous hydraulic connection in different working positions, the equipment-side hydraulic hoses usually have a longer hose length to compensate for the different positions and articulation angles of the backhoe equipment without disconnecting the hydraulic connections.

Other solutions, such as the system shown in EP 3 434 828 A1, rely on a pivotable attachment of one of the hydraulic coupling parts to the side of the boom, such that the mechanically and hydraulically coupled coupling parts can follow a change in working position.

Against this background, the object of the present disclosure is to enable a flexible, stable and easy-to-manufacture or easy-to-release coupling of the fluid-conducting supply lines in an attachment tool with a plurality of working positions.

According to the disclosure, this object is achieved by a working machine, a coupling device and a method as described herein.

Accordingly, a working machine is proposed, which comprises a first boom part, a second boom part detachably connectable to the first boom part, a first fluid-guiding line, at least one second fluid-guiding line and a coupling device for reversibly coupling the first and second lines. The at least one first line is arranged on the first boom part and the at least one second line is arranged on the second boom part. The first boom part can be a linkage piece that is pivotable, in particular pivotable about a horizontal axis, on an upper carriage of the working machine. The second boom part can be part of an attachment tool such as a backhoe tool of a demolition excavator or any other attachment tool. The coupling device is in particular a quick coupling. The fluid-conducting lines can be hydraulic lines.

The coupling device comprises a first coupling part connected to the at least one first line in a fluid-conducting manner and a second coupling part connected to the at least one second line in a fluid-conducting manner and connected to the second boom part. The coupling device further comprises a pivot part connected to the first boom part, which can be pivoted about a pivot axis. The pivot part and the coupling parts are arranged and designed in such a way that the first coupling part can be coupled to the second coupling part in a fluid-conducting manner by pivoting the pivot part about the pivot axis.

According to the disclosure, the working machine comprises a locking mechanism, by means of which the first coupling part can be mechanically connected to the pivot part for coupling and disconnecting the coupling parts, for example by mean of at least one bolt connection. This allows the first coupling part to be pivoted together with the pivot part about the pivot axis in order to bring the coupling parts together for coupling or to disconnect them for uncoupling. If the two coupling parts have been brought together, i.e. if the first coupling part is in a state in which it is connected or coupled to the second coupling part, it can be released from the pivot part by means of the locking mechanism, i.e. it can be mechanically separated therefrom. Subsequently, the pivot part can be pivoted around the pivot axis independently of the first coupling part, as these two parts are no longer mechanically connected to each other.

By separating the connection between the first coupling part and the pivot part, the first coupling part coupled with the second coupling part no longer has a fixed mechanical connection with the first boom part in particular. The coupling, on the other hand, is connected to the second boom part and can be moved together therewith, for example to change a working position of an attachment tool comprising the second boom part, wherein the orientation of the second boom part changes relative to the first boom part. This is not possible with conventional quick coupling systems, where each coupling part is permanently or firmly (although possibly movably or pivotably) connected to its boom part, as a change in the relative alignment of the boom parts would also change the alignment of the coupling parts to each other.

Therefore, in the present disclosure the first coupling part can be mechanically decoupled from the pivot part after coupling with the second coupling part for working operation. The at least one first fluid-conducting line, which is further connected to the first coupling part, is in particular designed to be flexible and long enough that a movement of the second boom part relative to the first boom part can take place, during which the coupled coupling parts are also moved. In working operation, the first coupling part is therefore connected in particular only via the at least one first line to the first machine-side boom part or to the carrier device.

During coupling and uncoupling of the two coupling parts, on the other hand, the first coupling part is connected to the pivot part such that a precise, defined and, in particular, automatic production and disconnection of the fluid-conducting coupling can take place. This is the main advantage over the known solution with manually connectable fluid lines in terms of time and effort.

The coupling parts can have a number of identical and/or differently designed connection connectors, which are coupled or connected to each other when the coupling parts are coupled, thereby creating fluid-conducting connections. The coupling parts can form a quick coupling.

In one possible embodiment, it is provided that the second coupling part is permanently connected to the second boom part, i.e. that it is not released therefrom either during working operation or for disconnecting the second boom part from the first boom part. This includes both a rigid or firm attachment of the second coupling part to the second boom part and a movable bearing, for example a pivot bearing. Optionally, however, the second coupling part is firmly attached, i.e. immovably attached to the second boom part. This includes that the second coupling part is mounted on or in a retaining frame, for example spring-mounted, which in turn is rigidly connected to the second boom part. In this case, the retaining frame can in particular be considered as part of the second coupling part.

Alternatively or additionally, the pivot part can be permanently connected to the first boom part, i.e. it is also not detached from the first boom part.

In a further possible embodiment, it is provided that the pivot part can be pivoted about the pivot axis by means of an actuator, in particular a hydraulic cylinder. In this way, a fully automatic coupling (and disconnection) of the first and second fluid-conducting lines can be achieved, which can be controlled, for example, from a driver's cab of the working machine. Manual connection or disconnection of the couplings or fluid-conducting lines is not necessary, which speeds up and simplifies the process. The pivot axis can be aligned horizontally, or the pivot part can be pivotably mounted on an upper side of the first boom part.

In a further possible embodiment, it is provided that after the first coupling part has been detached from the pivot part, there is no direct rigid connection between the first coupling part and the first boom part, i.e. the first coupling part is no longer directly rigidly connected to the first boom part (e.g. via the pivot part), but only via the connection between the first and second boom part, which can be movable in particular during the change of the working position. This includes the case where the first coupling part, after being detached from the pivot part, is connected to the at least one first line, which in turn may be firmly arranged on the first boom part. Since the at least one first line is in particular designed to be flexible, the first coupling part can be moved relative to the first boom part (and thus relative to the pivot part) after disconnection from the pivot part. The fluid connection between the two coupling parts remains intact. In particular, after the mechanical connection between the pivot part and the first coupling part has been released, the pivot part can be pivoted relative to the first coupling part about the pivot axis.

The term "direct rigid connection" therefore means, in particular, that the first coupling part is no longer firmly connected to the first boom part via the pivot part and also not via any other element attached to the first boom part (apart from the at least one first fluid-conducting line), but is now connected to the second boom part. The connection between the first and second boom part is not a "direct rigid connection" in this sense. In this respect, there is no direct rigid connection between the first coupling part and the first boom part in any direction after the first coupling part has been released from the pivot part.

In a further possible embodiment, it is provided that the second boom part can be connected to the first boom part in at least two different positions and is movable between a first working position and a second working position. These can be discrete working positions or a continuous adjustment. In particular, the boom parts can be coupled together via bolt connections, wherein these optionally form two parallel locking axes. One of the locking axes/bolt connections can remain connected or inserted and act as a pivot axis when changing between working positions, while the other bolt connection is released and other bolt receptacles are used to form this locking axis, resulting in a different orientation or inclination of the second boom part relative to the first boom part. Of course, other locking mechanisms and movement sequences for connecting the boom parts and changing between different working positions are also conceivable.

After releasing the connection of the first coupling part to the pivot part, the first coupling part is connected to the second boom part, in particular firmly connected. On the other hand, there is no longer a firm connection with the first boom part. When the working position is changed, the first coupling part can thus be moved together with the second boom part relative to the first boom part, so that the fluid-conducting connections made by the coupling device are not released. The two coupling parts can remain securely connected to each other, in particular locked, while the second boom part is moved.

In a further possible embodiment, it is provided that the locking mechanism is arranged on or in the first coupling part. This allows the same locking mechanism to be used for locking the first coupling part to the pivot part as well as for locking the two coupling parts.

In a further possible embodiment, it is provided that the locking mechanism comprises at least one actuator by means of which the first coupling part can be locked to the pivot part in a coupling position of the pivot part and can be unlocked therefrom. Optionally, the actuator is supplied via a flexible hydraulic line arranged on the first boom part, which can either be directly connected to the actuator or can supply it via the first coupling part (in this case, the hydraulic line is in particular one of the first fluid-conducting lines). Optionally, two actuators are provided to lock the coupling parts as well as the first coupling part and the pivot part together via two locking axes respectively.

Optionally, the at least one actuator for locking and unlocking the first coupling part can be actuated from a driver's cab and/or via a control device arranged on the working machine or a mobile control device. This eliminates the need for manual locking/unlocking, which simplifies and speeds up the process.

In a further possible embodiment, it is provided that the first coupling part can be locked to the second coupling part in the coupling position of the pivot part by means of the locking mechanism. As a result, the two coupling parts are firmly connected to each other such that the fluid-conducting connections cannot separate from each other.

Optionally, the locking mechanism is designed such that the locking of the coupling parts takes place simultaneously with the unlocking of the first coupling part and the pivot part and vice versa, in particular via the same at least one actuator. Therefore, while the first coupling part is released or unlocked from the pivot part, the two coupling parts are simultaneously locked (and vice versa), in particular via the same actuator(s) on the other side. This halves the number of actuators required for operation.

In a further possible embodiment, it is provided that the locking mechanism comprises at least one double-acting hydraulic cylinder as an actuator, which is connected or provided with bolts that are retractable into corresponding bolt receptacles on the second coupling part or on the pivot part by actuation of the hydraulic cylinder. This allows the same actuator to be used for simultaneously unlocking the first coupling part and the pivot part and locking both coupling parts. For example, while a first bolt, which can be moved and hydraulically actuated on or in the first coupling part, is pulled out of a bolt receptacle on the pivot part (unlocking), a second bolt on the opposite side moves into a corresponding bolt receptacle in or on the second coupling part (locking). The reverse procedure (locking the pivot part and first coupling part, unlocking the coupling parts) is carried out in the same way in reverse. The fact that the actuator is designed as a double-acting cylinder with piston rods connected to the bolts or designed as bolts means that a plurality of actuators does not have to be used for the different locking and unlocking operations.

Optionally, at least two double-acting hydraulic cylinders are provided, in particular four, wherein two hydraulic cylinders are arranged laterally in each case and form a common locking axis.

Optionally, each hydraulic cylinder is connected or provided with an outer bolt for insertion into a bolt receptacle on the pivot part and with an inner bolt for insertion into a bolt receptacle on the second coupling part. By extending the at least one hydraulic cylinder outwards, the first coupling part locks with the pivot part via the outer bolt. By extending the at least one hydraulic cylinder inwards, the first coupling part locks with the second coupling part via the inner bolt.

During the locking/unlocking phase, there may be an offset between the bolts and the associated bolt receptacles or locking holes due to manufacturing tolerances. In a further possible embodiment, it is therefore provided that chamfers are provided on the bolts and/or on the bolt receptacles to facilitate the insertion of the bolts into the bolt receptacles. The chamfers are in particular designed as circumferential chamfers.

Optionally, each hydraulic cylinder has (or is connected to) an inner and an outer bolt as previously described, wherein the chamfers are located on the bolts. The chamfers are optionally formed as chamfers running around the ends of the bolts. Optionally, the chamfers or bevels on the outer bolt and the chamfers or bevels on the inner bolt are designed differently. The chamfers or bevels have, in particular, different angles of inclination in relation to the respective longitudinal axis of the bolt and/or a different length along the respective longitudinal axis of the bolt. This allows concentricity errors due to manufacturing tolerances to be compensated for without overloading the cylinders, plates, hydraulic connections and bolts.

In a further possible embodiment, it is provided that the coupling device comprises a sensor device by means of which the coupling position of the pivot part can be detected. This enables fully automatic locking/unlocking of the coupling device, e.g. from the driver's cab. To do this, the driver must know when the coupling parts or the pivot part are in the correct position so that they can be locked together and the lock can be actuated. Since the coupling device is usually not visible or only insufficiently visible from the driver's cab, this information is provided via the sensor system, which comprises at least one sensor for detecting the position or the coupling position of the pivot part.

Optionally, the working machine has a control unit for controlling the at least one actuator of the locking mechanism, which is connected to the sensor system or the at least one sensor and is configured to enable actuation of the at least one actuator only when the pivot part is in the coupling position. This eliminates the possibility of operating errors.

In a further possible embodiment, it is provided that the coupling position of the pivot part is derived directly from the position of the pivot part and not, for example, from the position of an actuator. The coupling position (which can also be called the locking position, since in this position the two coupling parts can be locked together) is defined here by a mechanical stop, which, when the coupling position is reached, abuts a corresponding counter stop and thus positions the pivot part exactly in the coupling position. The stop is optionally arranged on the pivot part and interacts with a counter stop on the second coupling part or on the second boom part. Compared to a solution where the position of the part to be locked is not detected directly, but a position of an associated actuator is detected, the direct solution is closer to the locking function.

The at least one sensor of the sensor system described above is optionally an inductive sensor that detects when the pivot part has reached the coupling position by detecting the stop or counter stop and, in particular, transmits a corresponding signal to the control unit.

In a further possible embodiment, it is provided that the coupling parts are designed in such a way that they move towards each other on a circular path around the pivot axis when the pivot part is pivoted into the coupling position, thereby automatically coupling with each other in a fluid-conducting manner. At least one of the two coupling parts, in particular the second coupling part, is mounted so as to be pivotable about an axis parallel to the pivot axis of the pivot part and is also mounted so as to be movable or displaceable perpendicularly thereto, in particular via a spring device. Optionally, the coupling device comprises a linear guide, which, in cooperation with the movable bearing of the movable coupling part, is designed to compensate for the relative movement of the two coupling parts along a circular path when pivoting together and to guide the two coupling parts in a linear manner, i.e. along a straight line, towards each other when coupling. For this purpose, the linear guide on the coupling parts can have cooperating guide elements during coupling, which can be designed, for example, as guide bolts and bores, which engage with each other before the connecting connectors of the coupling parts are brought together and cause an exactly linear relative movement. In particular, the coupling parts may be designed as quick coupling parts according to EP 1 239 087 A1 and may further comprise a centring device according to DE 10 2020 110 523 A1. In this case, the non-movable (first) coupling part, i.e. not mounted via a spring device, is connected or connectable to and releasable from the pivot part. Both of the above disclosures are hereby explicitly referred to.

The present disclosure further relates to a coupling device for a working machine according to the disclosure. The coupling device comprises the first coupling part, the second coupling part and the pivot part. Obviously, the same advantages, properties and possible embodiments result as for the working machine according to the disclosure, which is why a repetitive description is dispensed with here.

The present disclosure further relates to a method for establishing are fern operating state of the working machine according to the disclosure, i.e. in particular a state in which the position of the second boom part relative to the first boom part can be changed, meanwhile the fluid-conducting coupling of the first and second lines via the two coupling parts remains in place and fully functional. The method comprises the following steps:

- pivoting the pivot part about the pivot axis into the coupling position, wherein the first coupling part is locked, i.e. mechanically, to the pivot part via the locking mechanism,
- locking the first coupling part to the second coupling part by means of the locking mechanism,
- detaching the locking between the first coupling part and the pivot part by means of the locking mechanism such that they are no longer firmly connected to each other (in this state, the first coupling part is no longer directly rigidly connected to the first boom part), wherein the unlocking optionally takes place simultaneously with the locking of the two coupling parts, and
- optionally pivoting the pivot part back about the pivot axis out of the coupling position (i.e. away from the first coupling part) such that in particular there is no longer contact between the pivot part and the first coupling part.

The reverse process takes place in reverse order, i.e. the pivot part is pivoted into the coupling position and locked with the first coupling part. Subsequently or (optionally) simultaneously, the locking of the two coupling parts is released (in particular by means of the same locking mechanism) such that the first coupling part is now firmly connected to the pivot part and no longer firmly connected to the second coupling part. Now, if necessary, the first coupling part can be removed from the second coupling part by pivoting the pivot part back, such that, for example, the second boom part can be detached from the first boom part.

BRIEF DESCRIPTION OF THE FIGURES

Further features, details and advantages of the disclosure result from the following exemplary embodiment explained with the help of the figures. In the figures.

DETAILED DESCRIPTION

Figure 1A:
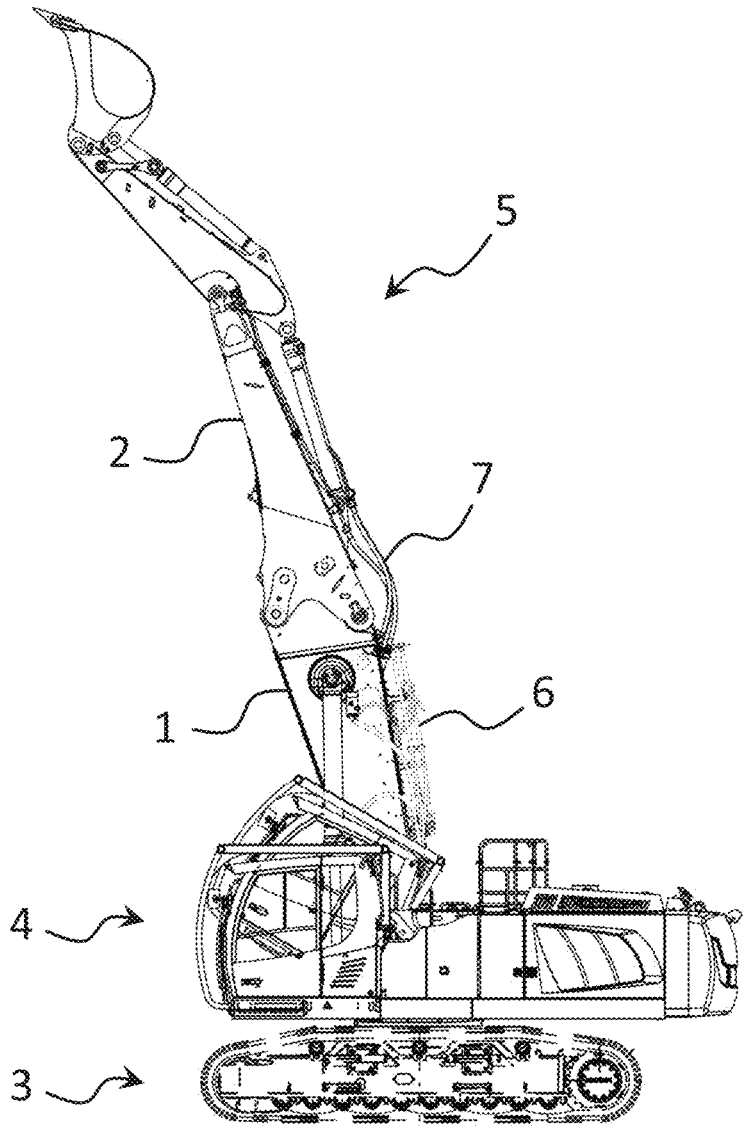
Fig. 1a (Prior Art)
FIGS. 1*a-b* show a first example of a working machine known from the prior art in a side view, wherein different working positions of the attachment tool are shown.
Figure 1B:
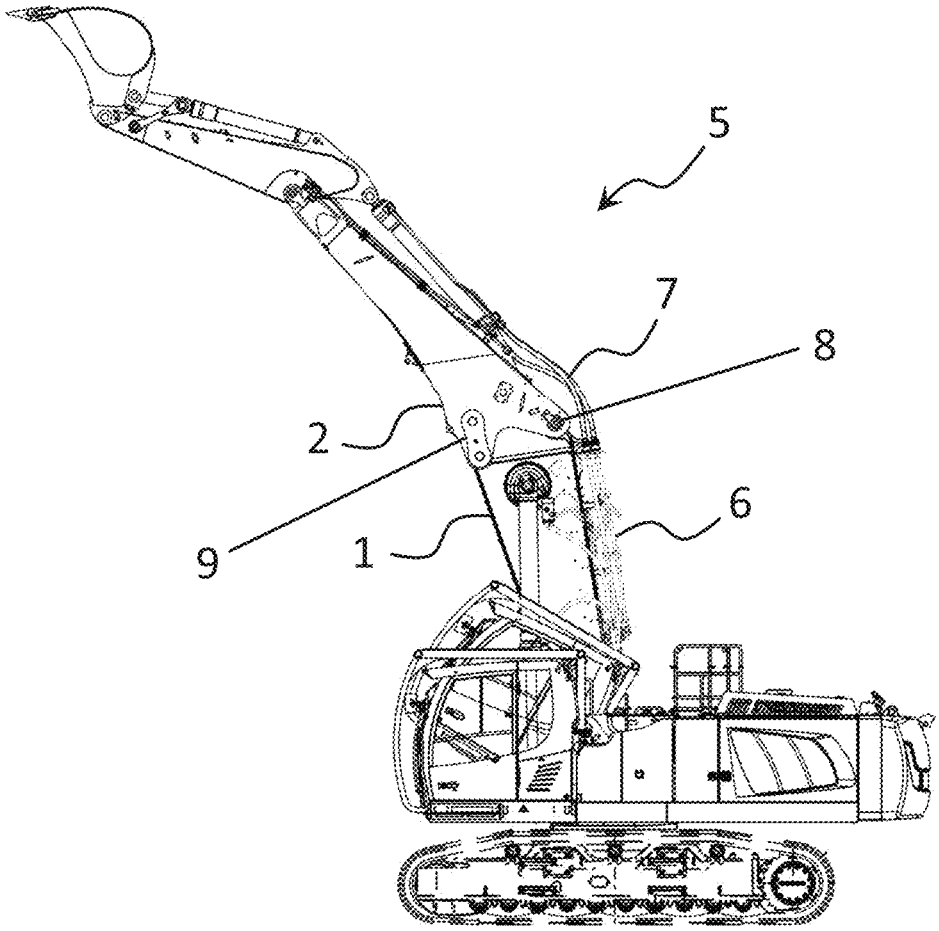
Fig. 1b (Prior Art)

FIGS. 1*a* and 1*b* show an example of a working machine known from the prior art in a side view. This example is a hydraulic excavator that has an undercarriage 3 with a crawler chassis and an upper carriage 4 with a driver's cab mounted on the undercarriage 3 such that it can rotate about a vertical axis of rotation. A first boom part 1 in the form of an articulated piece that can be pivoted about a horizontal axis via one or more hydraulic cylinders is articulated to the upper carriage 4.

An attachment tool 5 is mounted on the end of the first boom part 1 opposite the upper carriage 4, wherein the attachment tool 5 in the example shown here is backhoe equipment for demolition work. The working machine shown is therefore used as a demolition excavator. The attachment tool 5 comprises a second boom part 2 and a hydraulically movable backhoe or excavator bucket, wherein the second boom part 2 is connected to the free end of the first boom part 1 at its end opposite the backhoe. For this purpose, the ends of the first and second boom parts 1, 2 have corresponding connecting elements, in this case in the form of two bolt connections, which form two locking axes 8, 9 (see FIG. 1*b*).

The attachment tool 5 shown here has two discrete working positions, which are shown in FIGS. 1*a* and 1*b*. For this purpose, a first locking axis 8 is formed by a bolt connection that remains inserted in every working position and is used as a pivot axis for the attachment tool 5. The second locking axis 9, which runs parallel thereto, is repositioned to change the working position, such that the attachment tool 5 and consequently the second boom part 2 is inclined relative to the first boom part 1 about the first locking axis 8. For this purpose, the second boom part 2 (alternatively the first boom part 1) has two bolt receptacles so that one of the two working positions can be reached by inserting the bolts into the corresponding bolt receptacle. Of course, more than two working positions (i.e. more than two bolt receptacles) and/or continuous adjustment of the attachment tool 5 are also possible.

In order to be able to move the backhoe of the attachment tool 5, its actuator (in this case in the form of one or more hydraulic cylinders) must be connected to the hydraulic system of the base unit 3, 4. For this purpose, the hydraulic cylinders of the attachment tool 5 are connected to flexible hydraulic lines (=second fluid-carrying lines 7), which are attached to the second boom part 2 and the hydraulic connections of which are located in the area of the end of the second boom part 2. The corresponding machine-side hydraulic lines (=first fluid-conducting lines 6) are attached to the first boom part 1 and have corresponding hydraulic connections or connectors. After the first and second boom parts 1, 2 have been mechanically connected to each other (this is done in particular via a mechanical quick coupler of a known type), with such known devices the hydraulic lines 6, 7 are manually connected to each other in order to establish the hydraulic supply to the attachment tool 5.

For this purpose, the tool-side hydraulic lines 7 are increased in length such that they can bridge the kink or the inclinations resulting from the different working positions of the attachment tool 5 and the hydraulic connections do not disconnect. A hydraulic quick coupling, as known from EP 1 239 087 A1, for example, cannot be used for this purpose, as the alignment of the second boom part 2 relative to the first boom part 1 changes depending on the working position of the attachment tool 5.

Figure 2:
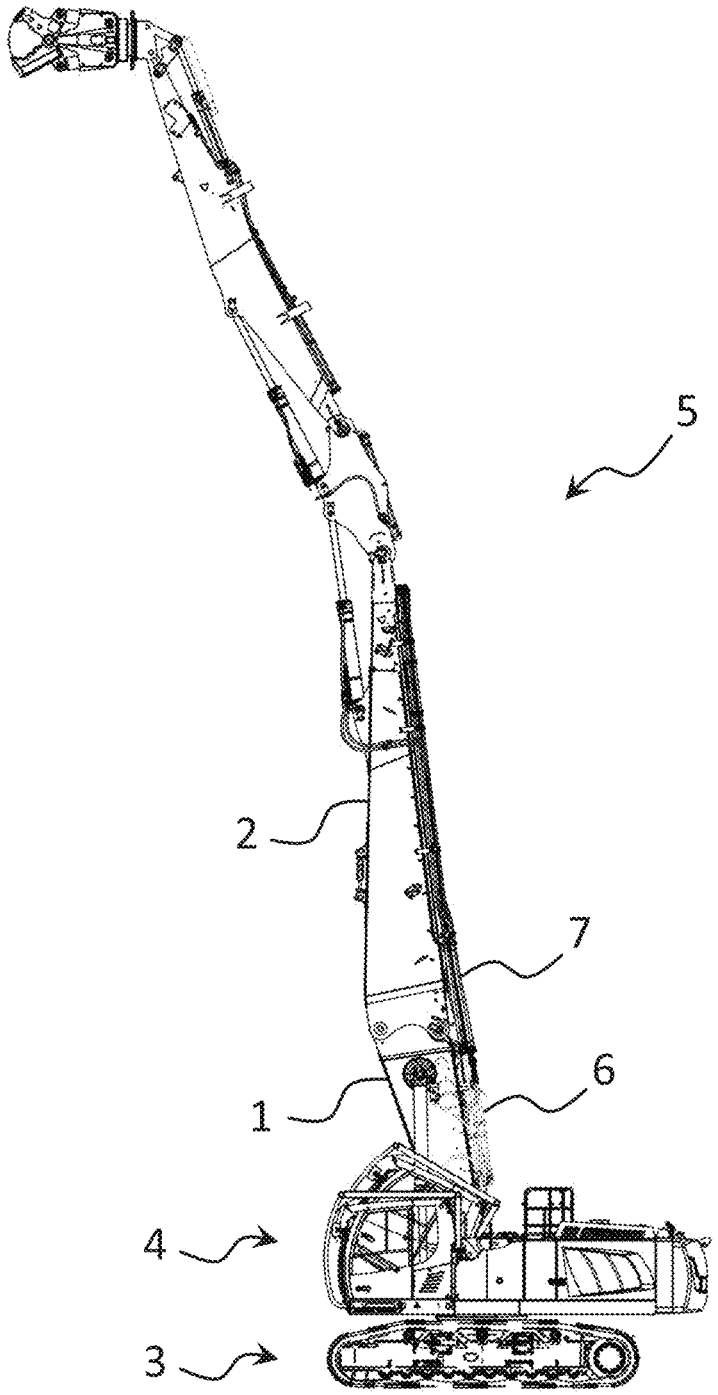
FIG. 2: shows a second example of a working machine known from the prior art in a side view.

FIG. 2 shows a further example of a working machine known from the prior art. This is the hydraulic excavator base unit of FIGS. 1*a-b*, wherein another attachment tool 5 has been added in the form of demolition equipment. This also has a second boom part 2, but in the example shown here it can only assume a single working position.

FIGS. 3-7 show different views of the coupling device according to the disclosure for the fully automatic production and disconnection of fluid-conducting lines at a boom disconnection point, for example the hydraulic supply lines for attachment tools. FIGS. 3-6 show the coupling device 10 in different positions in perspective views.

The coupling device 10 can be used in the working machines shown in FIGS. 1*a-b* and 2 for connecting the first and second lines 6, 7 (the corresponding features of the working machine according to the disclosure can correspond to those of FIGS. 1*a-b* and 2, except for the hydraulic connections, and are therefore not repeated again below), but is not limited to these working machines and attachment tools. In principle, the coupling device 10 according to the disclosure can be used for automatic coupling and disconnection of fluid-conducting lines at any disconnection points where different geometric configurations occur at the disconnection point, for example in demolition excavators, earth-moving excavators, pile-driving and drilling excavators, drilling machines, hoisting machines, loaders, bulldozers, cranes and mining excavators, to name but a few examples.

The coupling device 10 according to the disclosure comprises an energy circuit coupling in the form of a hydraulic quick coupling having two coupling halves or coupling parts 11, 12, which can be brought together and moved apart under actuator control. A first coupling part 11 is connected to the machine-side first lines 6 (not shown in FIGS. 3-7), while a second coupling part 12 is connected to the tool-side second lines 7 (also not shown). By pivoting together and coupling the two coupling parts 11, 12, which have corresponding connectors or hydraulic connections that fit into each other, the first and second lines 6, 7 are connected to each other in a fluid-conducting manner.

The coupling device 10 further comprises a pivot part 20, which is pivotably connected to the upper side of the first boom part 1 about a pivot axis 24 (aligned horizontally or parallel to the pivot axis of the first boom part 1 in the exemplary embodiment shown). The pivot part can be pivoted between a release position (see FIGS. 3-4) and a coupling position (see FIGS. 5-6) via an actuator 22 in the form of a hydraulic cylinder 22. The second coupling part 12 is firmly attached to the upper side of the second boom part 2.

Figure 3:
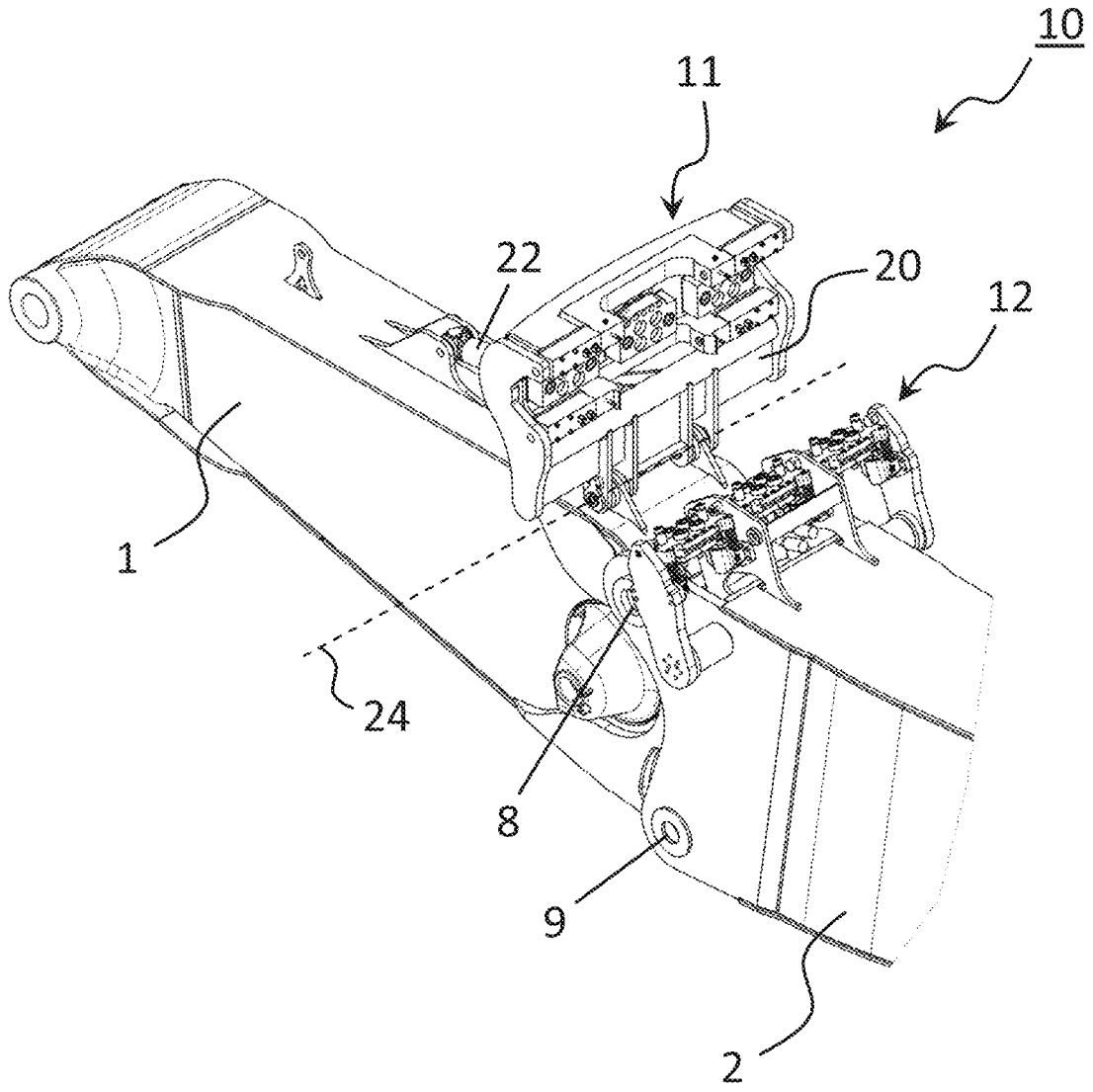
FIG. 3: shows a perspective view of the open coupling device of a working machine according to the disclosure according to a preferred exemplary embodiment.
Figure 4:
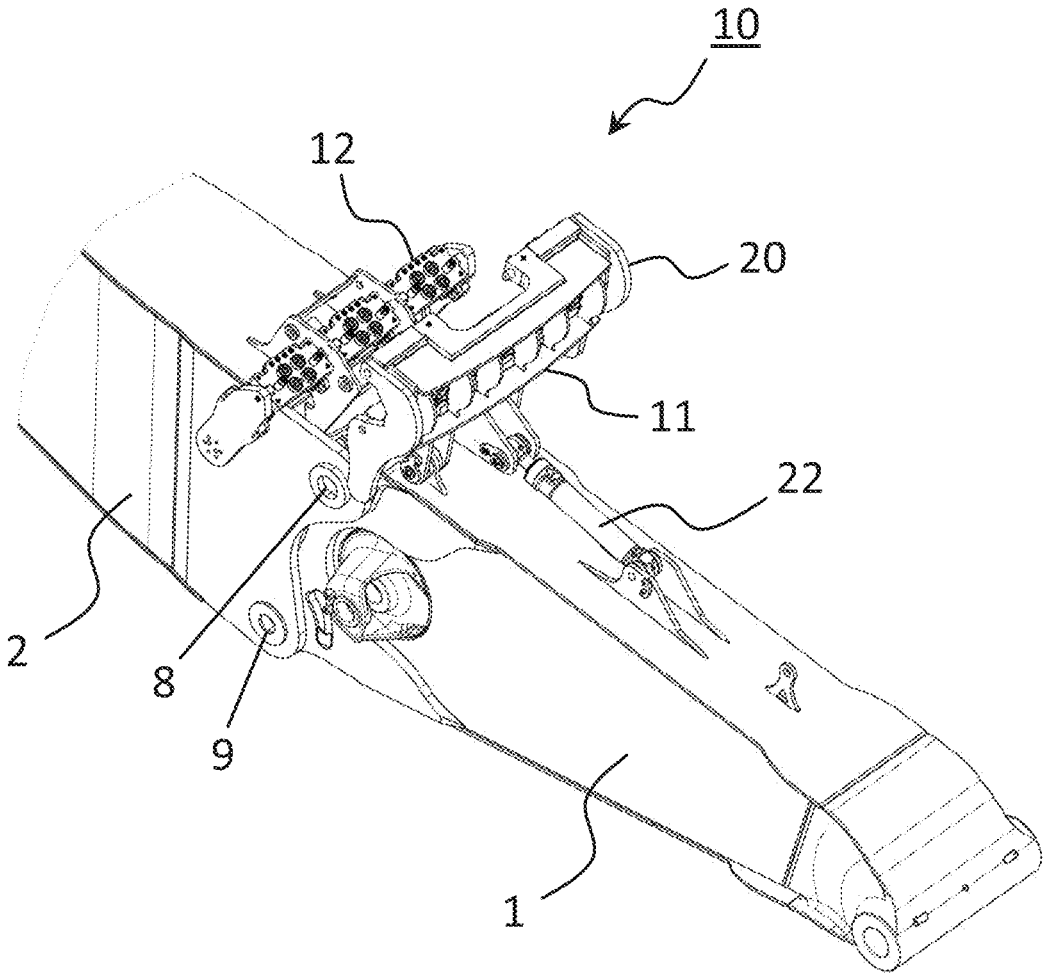
FIG. 4: shows the open coupling device in another view.
Figure 5:
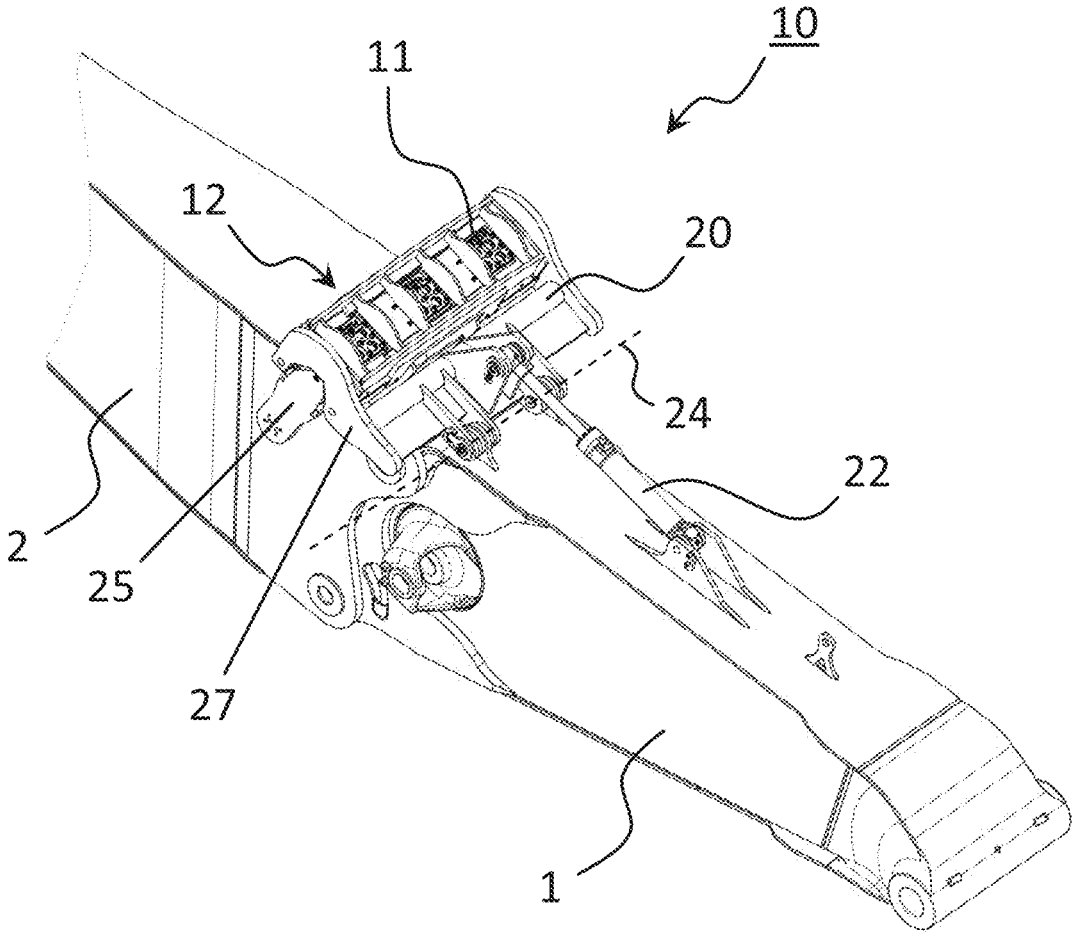
FIG. 5: shows the coupling device according to FIG. 4 in the coupled state.
Figure 6:
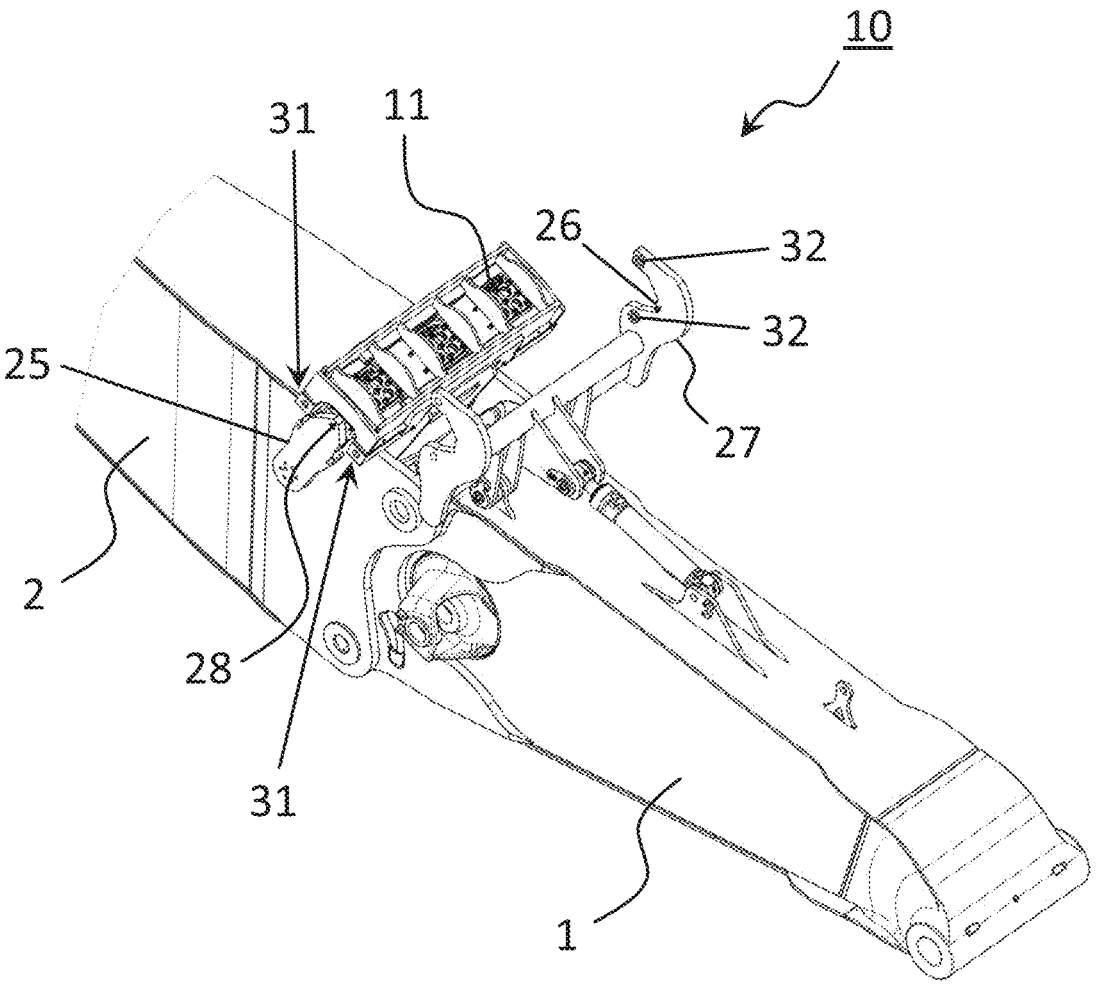
FIG. 6: shows the coupling device according to FIGS. 4 and 5, wherein the pivot part disconnected from the first coupling part is pivoted back.

The pivot part 20 is designed to receive or be releasably connected to the first coupling part 11 via a locking mechanism (explained later). This state is shown in FIGS. 3-4. Here, by pivoting the pivot part 20 about the pivot axis 24 from the release position along a circular path to the second coupling part 12, the two coupling parts 11, 12 can be pivoted together or coupled. In the process, the respective connectors move into each other. The coupling position of the pivot part 20, in which the two coupling parts 11, 12 are pivoted together and connected (but not necessarily locked), is shown in FIG. 5.

The coupling parts 11, 12 can form a quick coupling according to the teachings of EP 1 239 087 A1 and in particular have a corresponding linear guide. Furthermore, the coupling parts may comprise a centring device according to DE 10 2020 110 523 A1. In particular, the second coupling part 12 is designed as a movable coupling part in the sense of these two lines and is movably (but permanently) mounted on the second boom part 2 via a spring device 13 (see FIG. 7).

According to the disclosure, in order to make it possible to change the orientation of the second boom part 2 relative to the first boom part 1 after coupling the two coupling parts 11, 12 (for example, to change a working position of an attachment tool 5 comprising the second boom part 2), the first coupling part 11 can be disconnected from the pivot part 20 after the coupling parts 11, 12 have been brought together. For this purpose, the first coupling part comprises a locking mechanism with a plurality of actuators 31, which lock the first coupling part 11 either to the pivot part 20 or to the second coupling part 12.

Figure 7:
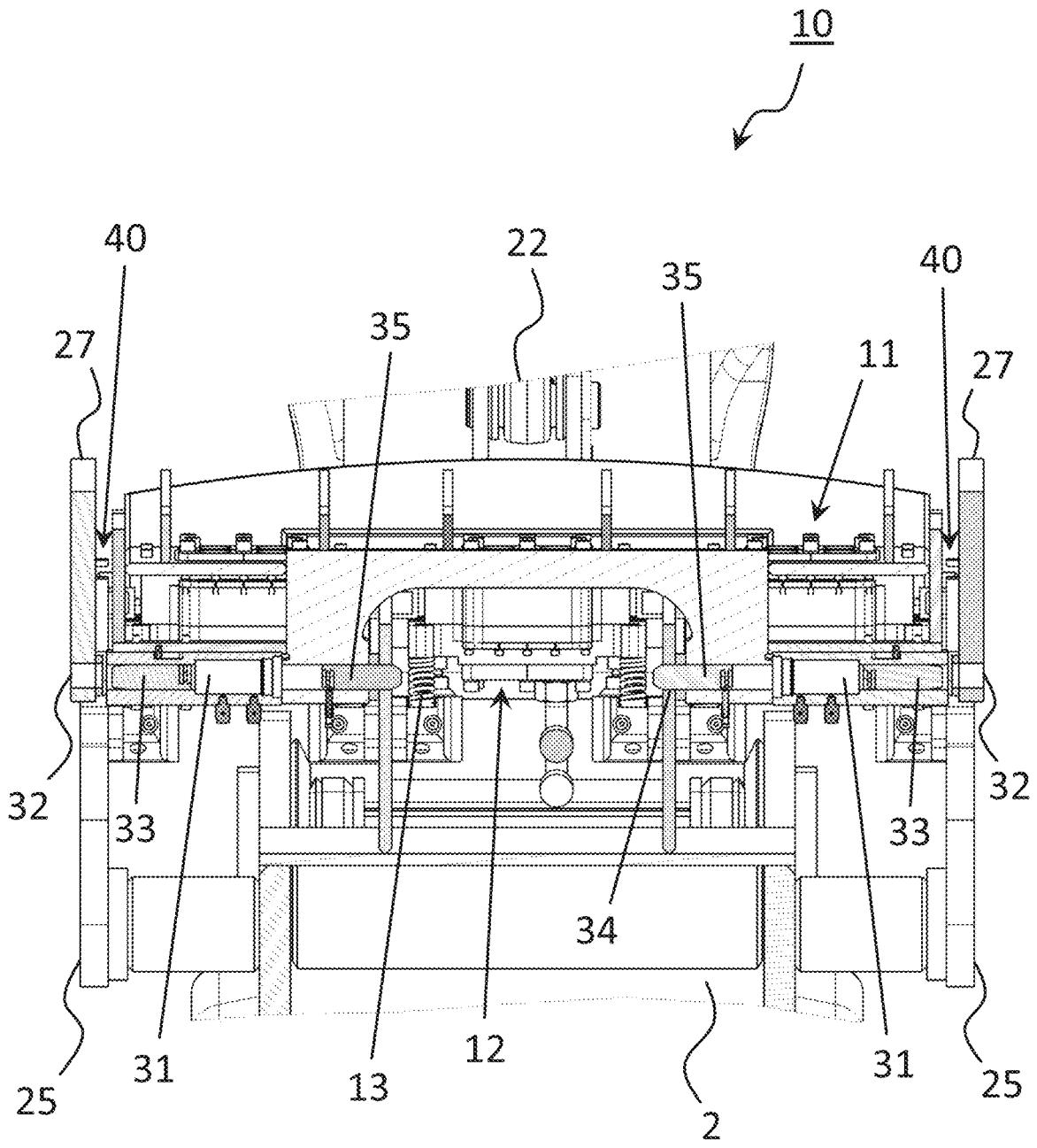
FIG. 7: shows a sectional view through the coupled coupling device.

A section parallel to the pivot axis 24 through the coupled coupling device 10 along one of the actuators 31 is shown in FIG. 7, wherein the pivot part 20 is in its coupling position. The pivot part 20 comprises two lateral hook-shaped side parts 27, which have downwardly open receptacles in the coupling position. The first coupling part 11 is in the coupling position between the side parts 27 and can be locked with them. For this purpose, the side parts 27 have bolt receptacles 32 (see FIG. 6; in the present exemplary embodiment there are two bolt receptacles 32 per side part 27). The first coupling part 11 comprises actuators 31 in the form of double-acting hydraulic cylinders, piston rods of which are designed as locking bolts 33, 35 on both sides. On the outer sides facing the side parts 27 of the pivot part 20, the outer bolts 33 lie coaxially with the bolt receptacles 32 of the side parts 27 in the coupling position of the pivot part.

When the outer bolts 33 are extended laterally or outwards and retracted into the bolt receptacles 32 of the side parts 27, the first coupling part 11 is locked to the pivot part 20 and can be pivoted together therewith. In this state, the first coupling part 11 has a direct rigid connection with the first boom part 1.

To unlock the first coupling part 11 and the pivot part 20, the bolts 33 are retracted inwards or pulled out of the bolt receptacles 32 of the side parts 27. Since the actuators 31 are designed as double-acting hydraulic cylinders, corresponding inner bolt 35, which lie parallel and in particular coaxial to the outer bolt 33 retract inwards. There are corresponding bolt receptacles 34 of the second coupling part 12 (or of a retaining frame rigidly connected to the second boom part 2, in which in the present exemplary embodiment the second coupling part 12 is movably mounted via a plurality of springs 13 of a spring device), into which the inner bolts 35 retract and thereby lock the two coupling parts 11, 12 together. In this state, the first coupling part 11 is no longer connected to the pivot part 20 and therefore no longer has a direct rigid connection to the first boom part 1 (except for the first lines 6, which are flexible and allow the first coupling part 11 to move relative to the first boom part 1).

Thus, the locking of the two coupling parts 11, 12 takes place synchronously or simultaneously with the unlocking of the first coupling part 11 and the pivot part 20. This means that only half as many actuators 31 need to be used as with separate, sequential locking/unlocking.

As can be seen in FIG. 7, the outer bolts 33 and the inner bolts 35 each have circumferential chamfers or bevels at their ends, which facilitate insertion into the respective bolt receptacles 32, 34 and also compensate for concentricity errors due to manufacturing tolerances. For this purpose, the bevels on the inner and outer bolts 33, 35 are optionally designed differently. In the exemplary embodiment shown here, the outer bolts 33 have flatter chamfers that have a greater reach (i.e. extension or length along the longitudinal axis of the bolt). The inner bolts 35 have steeper bevels with a shorter reach/length. This design makes it possible to compensate for manufacturing tolerances without overloading the cylinders 31, the plates, hydraulic connections or bolts 33, 35.

In the present exemplary embodiment, four actuators 31 are provided, which are arranged coaxially in pairs on the sides of the first coupling part 11 and therefore form two parallel locking axes. Of course, fewer (e.g. only two) or more than four actuators 31 could also be used.

As a result of the fact that after the connection between the first coupling part 11 and the pivot part 20 has been released, the first coupling part no longer has a direct rigid connection to the first boom part 1, the second boom part 2 can be moved or pivoted together with the coupled coupling parts 11, 12 without the hydraulic connections being impaired or even released. The hydraulic continuity therefore remains. For this purpose, after locking the two coupling parts 11, 12, the pivot part 20 in particular is pivoted back into the release position (see FIG. 6) such that no collisions can occur.

The movement sequence for establishing this operating state is shown in FIGS. 3-6. In FIG. 3, the first coupling part 11 is locked to the pivot part 20 and the pivot part 20 is in the release position. The lines 6, 7 are not connected or coupled to each other. By pivoting the pivot part 20 about the pivot axis 24 towards the second coupling part 12 into the coupling position (FIG. 5), the coupling parts 11, 12 are coupled to each other and thus fluid-conducting connections of the lines 6, 7 are established. In this case, the first coupling part 11 is still locked to the pivot part 20. Then the first coupling part 11 is simultaneously separated from the pivot part 20 and locked to the second coupling part 12. Afterwards, the now free pivot part 20 can be pivoted back into the release position (see FIG. 5).

Reaching the coupling position of the pivot part 20 can be detected, for example, by inductive sensors 40, which can be arranged on the second coupling part 12 or on the pivot part 20. The side parts 27 of the pivot part 20 comprise mechanical stops 26, which are formed by the "bottoms" of the downwardly open recesses. The second coupling part 12 or a retaining frame supporting it and connected to the second boom part 2 comprises two side parts 25, the ends of which facing the pivot part 20 form mechanical counter stops 28 (see FIG. 6), which are contacted by the stops 26 of the side parts 27 in the coupling position (see FIG. 5). The inductive sensors 40 directly detect these stops 26, 28 or the pivot part 20 or the second coupling part 12 (depending on where the sensors 40 are located) and output corresponding signals to a control unit of the working machine. This signals that the pivot part 20 is in the coupling position and therefore the unlocking/locking process can be carried out. Optionally, the operation is only released in the clutch position and is otherwise blocked.

Thus, the coupling process including locking/unlocking can be carried out automatically or remotely from the driver's cab without having to have visual contact with the coupling device 10 or carry out a manual check. The driver knows when to start unlocking/locking as this is detected and communicated by the sensors 40. In one embodiment, locking/unlocking does not have to be started by a driver, but all movements are fully automatic.

Alternatively, the pivot part and the coupling parts 11, 12 could also be arranged laterally or on the undersides of the boom parts 1, 2.

FIGS. 2-7, drawing to scale (although other relative sizing may be used, if desired) show example configurations with relative positioning of the various components. Unless otherwise noted, if shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

LIST OF REFERENCE NUMERALS

1 First boom part
2 Second boom part
3 Undercarriage
4 Upper carriage
5 Attachment tool
6 First fluid-conducting lines
7 Second fluid-conducting lines
8 First locking axis
9 Second locking axis
10 Coupling device
11 First coupling part
12 Second coupling part
13 Spring device
20 Pivot part
22 Actuator

24 Pivot axis
25 Side part
26 Stop
27 Side part
28 Counter stop
31 Actuator
32 Bolt receptacle
33 Outer bolt
34 Bolt receptacle
35 Inner bolt
40 Sensor

The invention claimed is:

1. Working machine having a first boom part, a second boom part detachably connectable to the first boom part, at least one first fluid-conducting line arranged on the first boom part, at least one second fluid-conducting line arranged on the second boom part and a coupling device for reversibly coupling the first and second lines, wherein the coupling device comprises a first coupling part connected to the at least one first line, a second coupling part connected to the at least one second line and connected to the second boom part, and a pivot part connected to the first boom part and pivotable about a pivot axis, wherein the first coupling part can be coupled to the second coupling part in a fluid-conducting manner by pivoting the pivot part, comprising a locking mechanism, by means of which the first coupling part for coupling and disconnecting the coupling parts can be mechanically connected to the pivot part and can be detached from the pivot part in a state coupled with the second coupling part.

2. Working machine according to claim 1, wherein the second coupling part is permanently connected to the second boom part and/or the pivot part is permanently connected to the first boom part.

3. Working machine according to claim 1, wherein the pivot part can be pivoted about the pivot axis by means of an actuator, a hydraulic cylinder.

4. Working machine according to claim 1, wherein after detaching the first coupling part from the pivot part, there is no direct, rigid connection between the first coupling part and the first boom part.

5. Working machine according to claim 1, wherein the second boom part can be connected to the first boom part in at least two position and can be moved between a first working position and a second working position, wherein after detaching the first coupling part from the pivot part the first coupling part is connected, firmly connected to the second boom part, and wherein when changing the working position the first coupling part can be moved together with the second boom part relative to the first boom part.

6. Working machine according to claim 1, wherein the locking mechanism is arranged on the first coupling part.

7. Working machine according to claim 1, wherein the locking mechanism comprises at least one actuator, by means of which the first coupling part can be locked in a coupling position of the pivot part with the pivot part and can be unlocked therefrom, wherein the actuator for locking and unlocking the first coupling part can be actuated from a driver's cab and/or via a control device arranged on the working machine or a mobile control device.

8. Working machine according to claim 1, wherein the first coupling part can be locked to the second coupling part in the coupling position of the pivot part by means of the locking mechanism, wherein the locking of the coupling parts takes place simultaneously with the unlocking of the first coupling part and the pivot part and vice versa, via the same at least one actuator).

9. Working machine according to claim 1, wherein the locking mechanism comprises at least two double-acting hydraulic cylinders, which are connected to or provided with bolts, which can be retracted into bolt receptacles on the second coupling part or on the pivot part by actuating the hydraulic cylinders.

10. Working machine according to claim 9, wherein chamfers are provided on the bolts and/or on the bolt receptacles to facilitate the insertion of the bolts into the bolt receptacles, wherein each hydraulic cylinder is connected to or provided with an outer bolt for insertion into a bolt receptacle on the pivot part and an inner bolt for insertion into a bolt receptacle on the second coupling part, and the inner and outer bolts have differently formed chamfers.

11. Working machine according to claim 7, wherein the coupling device comprise a sensor device having at least one sensor, by means of which the coupling device of the pivot part can be detected, wherein the working machine comprises a control unit for controlling the at least one actuator of the locking mechanism, which is connected to the at least one sensor and is designed to enable actuation of the at least one actuator only when the pivot part is in the coupling position.

12. Working machine according to claim 11, wherein the coupling position of the pivot part is derived directly from its position and is defined by a mechanical stop, which is arranged on the pivot part and cooperates with a counter stop on the second coupling part or on the second boom part, wherein the at least one sensor is designed as an inductive sensor.

13. Working machine according to claim 1, wherein the coupling parts are designed such that they move towards each other on a circular path about the pivot axis by pivoting the pivot part into a coupling position and thereby automatically couple with each other in a fluid-conducting manner, wherein at least one of the coupling parts, the second coupling part, is mounted so as to be pivotable about an axis parallel to the pivot axis of the pivot part and movable perpendicularly thereto, via a spring device, wherein the coupling device comprises a linear guide, which is designed to compensate, in cooperation with the movable bearing of the movable coupling part, the relative movement of the two coupling parts along a circular path when pivoting together and to guide the two coupling parts linearly to each other when coupling.

14. Coupling device for a working machine according to claim 1.

15. Method for establishing an operating state of a working machine according to claim 1, comprising the following steps:

pivoting the pivot part about the pivot axis into the coupling position, wherein the first coupling part is locked to the pivot part via the locking mechanism, locking the first coupling part to the second coupling part by means of the locking mechanism, and detaching the locking between the first coupling part and the pivot part by means of the locking mechanism such that they are no longer firmly connected to each other.

16. The method of claim 15, further comprising pivoting the pivot part back about the pivot axis out of the coupling position such that there is no contact between the pivot part and the first coupling part.

17. The method of claim 15 wherein the unlocking takes place simultaneously with the locking of the first and second coupling parts.

* * * * *